US008123532B2

(12) United States Patent
Davison et al.

(10) Patent No.: US 8,123,532 B2
(45) Date of Patent: Feb. 28, 2012

(54) CARRIER SYSTEM FOR AN ELECTRICAL CONNECTOR ASSEMBLY

(75) Inventors: Andrew Charles Davison, Harrisburg, PA (US); Craig Warren Hornung, Harrisburg, PA (US); John Joseph Consoli, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/758,083

(22) Filed: Apr. 12, 2010

(65) Prior Publication Data

US 2011/0250788 A1 Oct. 13, 2011

(51) Int. Cl.
*H01R 12/00* (2006.01)

(52) U.S. Cl. ..... 439/79

(58) Field of Classification Search ..... 439/79, 439/540.1, 541.5, 608, 701, 108, 532
See application file for complete search history.

(56) References Cited

U.S. PATENT DOCUMENTS 4,852,172 A * 7/1989 Taguchi ..... 704/238
6,010,373 A 1/2000 Donahue
6,123,554 A 9/2000 Ortega et al.
6,296,518 B1 * 10/2001 Avery et al. ..... 439/541.5
6,315,605 B1 11/2001 Billman et al.
6,494,724 B1 12/2002 Bixler et al.
6,517,360 B1 * 2/2003 Cohen ..... 439/65
6,582,250 B2 6/2003 Taylor et al.
6,655,988 B1 * 12/2003 Simmons et al. ..... 439/541.5
6,743,057 B2 * 6/2004 Davis et al. ..... 439/701
6,884,117 B2 4/2005 Korsunsky et al.
7,320,621 B2 1/2008 Laurx et al.
2004/0229509 A1 * 11/2004 Consoli et al. ..... 439/608

* cited by examiner

*Primary Examiner* — Tulsidas C Patel
*Assistant Examiner* — Harshad Patel

(57) ABSTRACT

An electrical connector assembly includes a first connector module including pins configured to be terminated to a circuit board and a second connector module including pins configured to be terminated to the circuit board. The electrical connector assembly also includes a carrier system including an organizer having openings therethrough in a predetermined pattern. The organizer is coupled to the first and second connector modules such that at least some of the pins of the first connector module extend through the openings of the organizer and such that at least some of the pins of the second connector module extend through the openings of the organizer. The first connector module, the second connector module and the organizer are configured to be mounted to the circuit board as a bundled unit.

19 Claims, 6 Drawing Sheets

CARRIER SYSTEM FOR AN ELECTRICAL CONNECTOR ASSEMBLY

BACKGROUND OF THE INVENTION

The subject matter herein relates generally to electrical connectors, and more particularly, to multiple electrical connectors arranged in an assembly.

Electrical connectors have been developed that are manually installed onto printed circuit boards and other structures. Often, a large number of electrical connectors, such as up to twenty electrical connectors, are installed on a single printed circuit board. Installation of electrical connectors can involve inserting hundreds of pins located on the electrical connectors into corresponding receiving holes in a printed circuit board or other structure. Known systems utilize stiffening devices to hold multiple electrical connectors together for simultaneous mounting to the circuit board. However, such stiffening devices are used on electrical connectors having equal heights and lengths such that the tops and backs of the electrical connectors are all aligned with one another. Additionally, such stiffening devices do not address any needs for maintaining positions of the pins.

Typically, there are several different types and sizes of electrical connectors that are mountable on a printed circuit board. Customers often want custom arrangements of electrical connectors for installation onto printed circuit boards. Known stiffening devices are not adequate for use in such situations as the stiffening devices cannot accommodate different height or different length electrical connectors. Rather, in order to attain a desired custom arrangement of modules on a printed circuit board, a customer manually installs the different desired modules one by one onto the printed circuit boards which can be very time consuming.

A need remains for an improved device for holding multiple electrical connectors together in an electrical connector assembly.

BRIEF DESCRIPTION OF THE INVENTION

In one embodiment, an electrical connector assembly is provided including a first connector module including pins configured to be terminated to a circuit board and a second connector module including pins configured to be terminated to the circuit board. The electrical connector assembly also includes a carrier system including an organizer having openings therethrough in a predetermined pattern. The organizer is coupled to the first and second connector modules such that at least some of the pins of the first connector module extend through the openings of the organizer and such that at least some of the pins of the second connector module extend through the openings of the organizer. The first connector module, the second connector module and the organizer are configured to be mounted to the circuit board as a bundled unit.

In another embodiment, an electrical connector assembly is provided having that includes walls defining an outer perimeter and pins configured to be terminated to a circuit board. The electrical connector assembly also includes a second connector module having walls defining an outer perimeter and pins configured to be terminated to the circuit board. A carrier system includes an organizer having openings therethrough in a predetermined pattern that is coupled to the first and second connector modules such that at least some of the pins of the first connector module extend through the openings of the organizer and such that at least some of the pins of the second connector module extend through the openings of the organizer. The carrier system also includes a stiffening member being coupled to the first and second connector modules that spans between corresponding walls of the first and second connector modules to hold the first and second connector modules together. The first connector module, the second connector module and the carrier system are configured to be mounted to the circuit board as a bundled unit.

In a further embodiment, an electrical connector assembly is provided having a first connector module that includes walls defining an outer perimeter. The first connector module is configured to be mounted to a circuit board. A second connector module includes walls defining an outer perimeter that is configured to be mounted to the circuit board adjacent the first connector module. At least one of the walls of the first connector module is off-set with respect to corresponding walls of the second connector module such that the outer perimeters of the first and second connector modules are out of alignment with respect to one another. The electrical connector assembly also includes a carrier system having a stiffening member coupled to the first and second connector modules that has a transition section spanning between corresponding walls of the first and second connector modules that are offset with respect to one another. The first connector module, the second connector module and the stiffening member are configured to be mounted to the circuit board as a bundled unit.

DETAILED DESCRIPTION OF THE INVENTION

Figure 1:
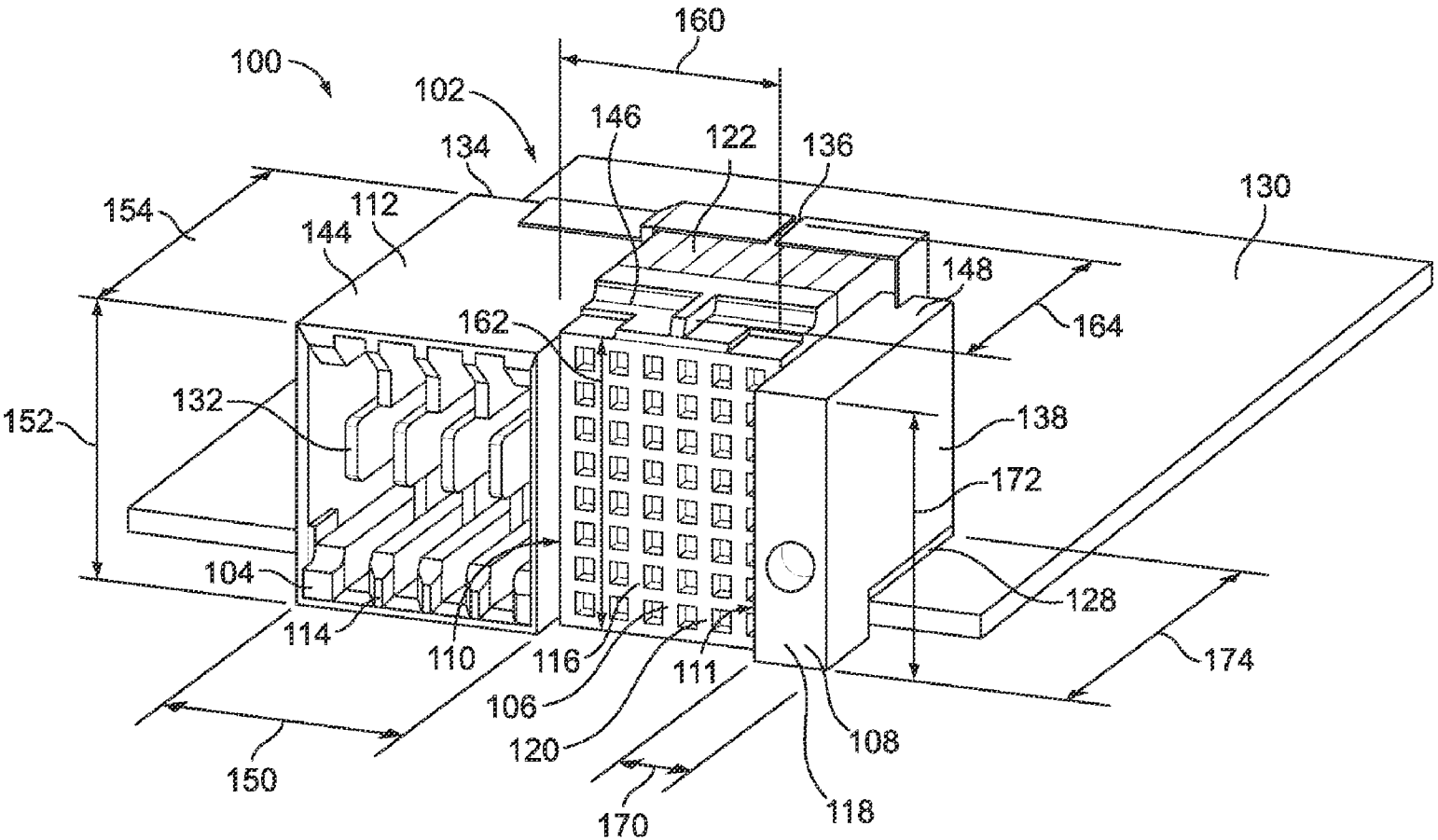
FIG. 1 is a front perspective view of an electrical connector assembly having a carrier system.

FIG. 1 is a front perspective view of an electrical connector assembly 100 having a carrier system 102. The electrical connector assembly 100 includes a plurality of connector modules 104, 106, 108 that are, by way of example only, generally of rectangular block shape. The connector modules 104, 106, 108 are located adjacent to, and in direct contact with one another, at meeting interfaces 110, 111. Any number and any type of connector modules may be provided, including multiple ones of the same types of connector modules. The connector modules 104, 106, 108 are merely examples of different types of connector modules that may be used depending on the particular application and desired mating interface. The connector modules 104, 106, 108 may be placed in an order determined by an application in which the connector modules 104, 106, 108 are to be used.

The connector modules 104, 106, 108 include walls 112 defining an outer perimeter of the corresponding connector modules 104, 106, 108, which may generally be rectangular block shaped or have other shapes in alternative embodiments. The walls 112 may be defined by a housing 120 of the corresponding connector modules 104, 106, 108 and/or by individual chicklets 122 received in the housing 120.

In an exemplary embodiment, the connector modules 104, 106, 108 are right angle connector modules, having front mating walls 114, 116, 118, respectively, and bottom mounting walls 124, 126, 128 (shown in FIG. 2), respectively. The front mating walls 114, 116, 118 are configured for mating engagement with corresponding mating connectors (not shown). The bottom mounting walls 124, 126, 128 are configured for mounting to a circuit board 130. Contacts 132 held by the corresponding connector modules 104, 106, 108 are terminated to the circuit board 130 and are configured for mating engagement with corresponding mating contacts of mating connectors. The front mating walls 114, 116, 118 are formed at a right angle to the bottom mounting walls 124, 126, 128.

The connector modules 104, 106, 108 have rear walls 134, 136, 138, respectively, generally opposite the front mating walls 114, 116, 118, respectively. The connector modules 104, 106, 108 have outer walls 144, 146, 148, respectively, at a top of the connector modules 104, 106, 108 generally opposite the bottom mounting walls 124, 126, 128. In an alternative embodiment, rather than being right angle connectors, the connector modules 104, 106, 108 may be vertical connectors that have mating and mounting walls that are opposite to one another, as opposed to being at right angles with respect to one another.

In the illustrated embodiment, the connector module 104 constitutes a power electrical connector. The connector module 106 constitutes a signal electrical connector. The connector module 108 constitutes a guide module. Other types of connector modules may be used in alternative embodiments, and the electrical connector assembly 100 may be utilized without a power electrical connector, a signal electrical connector and/or a guide module.

The connector module 104 includes a width 150, a height 152, and depth 154. The connector module 106 includes a width 160 that is different than the width 150 of the connector module 104, a height 162 that is different than the height 152 of the connector module 104, and a depth 164 that is different than the depth 154 of the connector module 104. As such, the outer wall 146 is off-set with respect to the outer wall 144 by a predetermined amount, the rear wall 136 is off-set with respect to the rear wall 134 by a predetermined amount and/or the front mating wall 116 is off-set with respect to the front mating wall 114 by a predetermined amount. Optionally, at least one of the width 160, height 162 or depth 164 may be the same as the corresponding width 150, height 152 or depth 154 of the connector module 104.

The connector module 108 includes a width 170 that is different than the widths 150, 160, a height 172 that is different than the heights 152, 162, and a depth 174 that is different than the depths 154, 164. As such, the outer wall 146 is off-set with respect to the outer wall 148 by a predetermined amount, the rear wall 136 is off-set with respect to the rear wall 138 by a predetermined amount and/or the front mating wall 116 is off-set with respect to the front mating wall 118 by a predetermined amount. Optionally, at least one of the width 170, height 172 or depth 174 may be the same as the corresponding widths 150 and/or 160, heights 152 and/or 162, or depths 154 and/or 164.

In an exemplary embodiment, the bottom mounting walls 124, 126, 128 are aligned with one another, however because the connector modules 104, 106, 108 have different heights 152, 162, 172, the outer walls 144, 146, 148 are non-coplanar with one another. In the illustrated embodiment, the front mating walls 114, 116, 118 are non-coplanar with one another and the rear walls 134, 136, 138 are non-coplanar with one another. In alternative embodiments, any of the walls 112 may be co-planar with any of the other walls 112.

The carrier system 102 is connected to each of the connector modules 104, 106, 108 to secure the connector modules 104, 106, 108 together as a bundled unit. The carrier system 102 locates the connector modules 104, 106, 108 adjacent to, and in direct contact with, one another at the meeting interfaces 110, 111 in an order determined by a particular application for which the electrical connector assembly 100 is intended. The carrier system 102 gives structural support to the electrical connector assembly 100 such that the electrical connector assembly 100 may be mounted to the circuit board 130.

Figure 2:
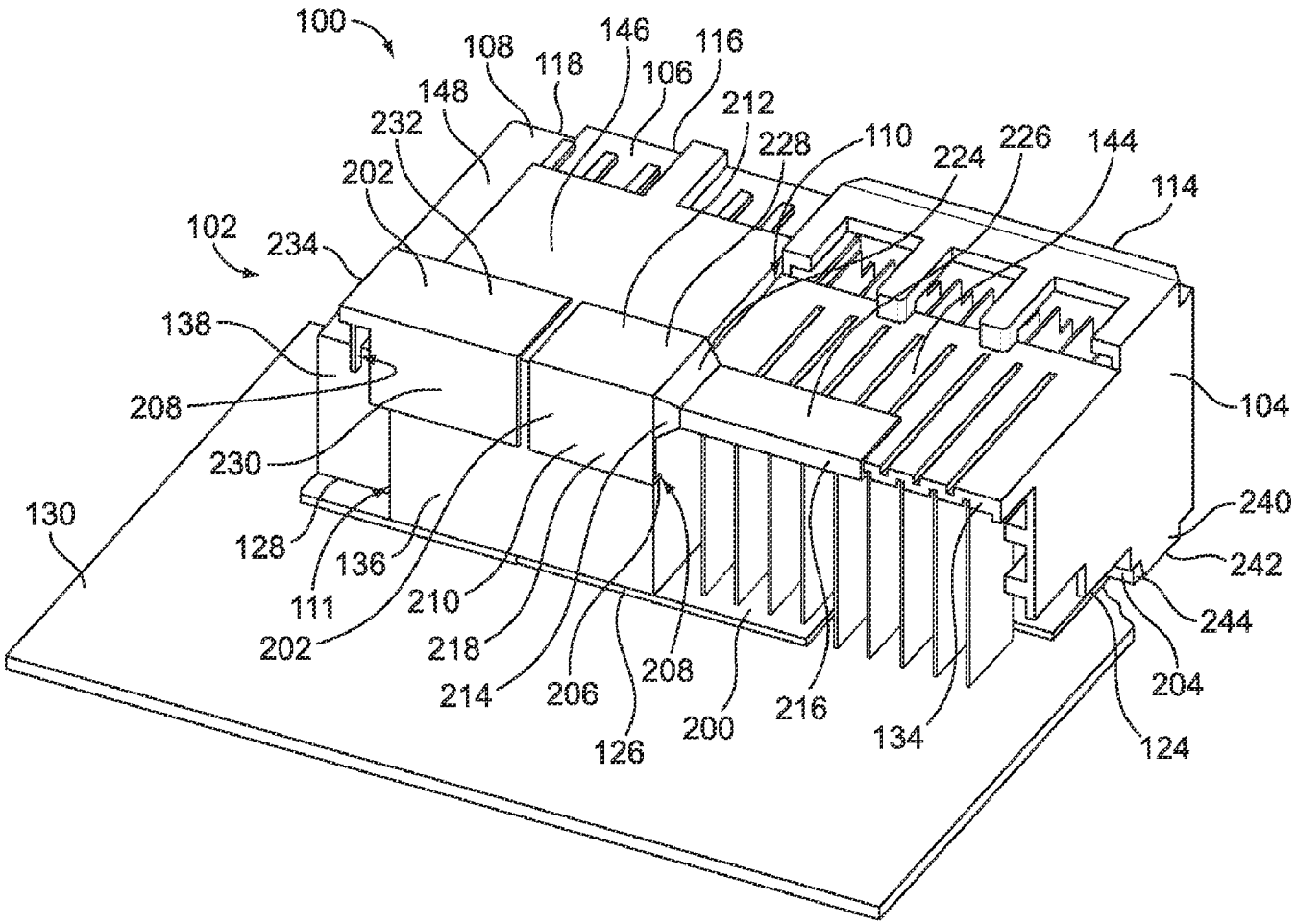
FIG. 2 is a rear perspective view of the electrical connector assembly shown in FIG. 1.

FIG. 2 is a rear perspective view of the electrical connector assembly 100 mounted to the circuit board 130. The carrier system 102 is coupled to the connector modules 104, 106, 108. The carrier system 102 includes one or more organizer(s) 200, one or more rear stiffening member(s) 202 and one or more front stiffening member(s) 204. The carrier system 102 may be provided without the organizer 200, the rear stiffening member 202 and/or the front stiffening member 204 in alternative embodiments.

The organizer 200 is provided at the bottom mounting walls 124, 126, 128 between the connector modules 104, 106, 108 and the circuit board 130. The organizer 200 holds the relative positions of the connector modules 104, 106, 108 for mounting the electrical connector assembly 100 to the circuit board 130 as a bundled unit. The organizer 200 spans across corresponding meeting interfaces 110, 111 to engage corresponding connector modules 104, 106, 108.

The rear stiffening member 202 is provided proximate to the rear walls 134, 136, 138. The rear stiffening member 202 holds the relative positions of the connector modules 104, 106, 108 for mounting the electrical connector assembly 100 to the circuit board 130 as a bundled unit. In the illustrated embodiment, two rear stiffening members 202 are provided, each spanning across a corresponding meeting interface 110, 111, however a single rear stiffening member 202 may be provided in an alternative embodiment. Each rear stiffening member 202 is a metal component that is shaped to conform to the corresponding connector modules 104, 106, 108 to engage the corresponding connector modules 104, 106, 108. The metal component is rigid and is configured to retain its shape once formed, which allows the rear stiffening member 202 to securely hold the connector modules 104, 106 108 together. The rear stiffening member 202 may be stamped and formed into a predetermined shape corresponding to the particular layout of connector modules 104, 106, 108. When formed, the rear stiffening member 202 includes keys 206 that extend into corresponding keyways 208 formed in the walls 112 of the connector modules 104, 106, 108. The position, shape and orientation of the keys 206 may be specific to the geometry of the particular connector modules 104, 106, 108. For example, the size, shape, relative position, location of keyways 208, and the like of the connector modules 104, 106, 108 may dictate the positioning of the keys 206. The shape of the rear stiffening member 202 may be configurable, such as by a bending or forming process, to accommodate varying connector geometries, such as by transitioning across off-set walls 112 to the particular connector modules 104, 106, 108.

Optionally, as in the illustrated embodiment, the rear stiffening member 202 may engage the rear walls 134, 136, 138 and the outer walls 144, 146, 148. For example, the rear stiffening member 202 includes a rear arm 210 and an outer arm 212 extending from the rear arm 210. Alternatively, the rear stiffening member 202 may include only the rear arm 210 engaging the rear walls 134, 136, 138 or the outer arm 212 engaging only the outer walls 144, 146, 148, but not both. In an exemplary embodiment, because the rear walls 134, 136 are non-coplanar, with the rear wall 134 being closer to the front of the electrical connector assembly 100 than the rear wall 136, the rear stiffening member 202 engaging the connector modules 104, 106 includes a transition section 214 that transitions between the plane of the rear wall 134 and the plane of the rear wall 136. The rear arm 210 of the rear stiffening member 202 includes a first rear arm section 216 that extends along, and engages, the rear wall 134 and a second rear arm section 218 that extends along, and engages, the rear wall 136. The first rear arm section 216 is generally parallel to, and non-coplanar with respect to, the second rear arm section 218. The transition section 214 extends between the first and second rear arm sections 216, 218. The transition section 214 is not parallel to the first and second rear arm sections 216, 218, but rather extends at an angle between the first and second rear arm sections 216, 218. Optionally, the transition section 214 may be angled at approximately a 45° angle. Alternatively, the transition section 214 may be angled at a 90° angle or any other angle. The length of the transition section 214 may depend on the amount of off-set between the rear walls 134, 136.

In an exemplary embodiment, because the outer walls 144, 146 are non-coplanar, with the outer wall 144 being lower than the outer wall 146 (e.g. closer to the circuit board 130), the rear stiffening member 202 engaging the connector modules 104, 106 includes a transition section 224 that transitions between the plane of the outer wall 144 and the plane of the outer wall 146. The outer arm 212 of the rear stiffening member 202 includes a first outer arm section 226 that extends along, and engages, the outer wall 144 and a second outer arm section 228 that extends along, and engages, the outer wall 146. The first outer arm section 226 is generally parallel to, and non-coplanar with respect to, the second outer arm section 228. The transition section 224 extends between the first and second outer arm sections 226, 228. The transition section 224 is not parallel to either of the first or second outer arm sections 226, 228, but rather extends at an angle between the first and second outer arm sections 226, 228. Optionally, the transition section 224 may be angled at approximately a 45° angle. Alternatively, the transition section 224 may be angled at a 90° angle or any other angle. The length of the transition section 224 may depend on the amount of off-set between the outer walls 144, 146.

The rear stiffening member 202 coupling the connector module 106 and the connector module 108 is different than the rear stiffening member 202 being used to couple the connector module 106 and the connector module 104. The rear stiffening member 202 being used to couple the connector modules 106, 108 includes a rear arm 230 and an outer arm 232. The rear arm 230 only engages the connector module 106 and does not engage the connector module 108. The outer arm 232 engages both the connector modules 106, 108. The outer arm 232 includes a transition section 234 that bends the outer arm 232 at a 90° angle, and the outer arm 232 extends from the transition section 234 vertically into the keyway 208 in the outer wall 148 of the connector module 108. The outer arm 232 holds the top of the connector module 108 in proper position against the connector module 106.

The connector modules 104, 106, 108 each include overhang portions 240 that are located proximate the front mating walls 114, 116, 118. The overhang portions 240 extend downward from the bottom mounting walls 124, 126, 128 to form a shelf 242 therebetween having abutment surfaces 244 that abut against an edge of the circuit board 130. A portion of the circuit board 130 has been illustrated as cut away to illustrate the overhang portion 240, shelf 242 and abutment surface 244 of the connector module 104. The connector modules 106, 108 include similar overhang portions 240, shelves 242 and abutment surfaces 244. In an exemplary embodiment, the abutment surfaces 244 are coplanar. The front stiffening member 204 is coupled to the connector modules 104, 106, 108 proximate to the overhang portions 240 to hold the connector modules 104, 106, 108 together. In an exemplary embodiment, the front stiffening member 204 engages the abutment surfaces 244 to hold the connector modules 104, 106, 108 together.

Figure 3:
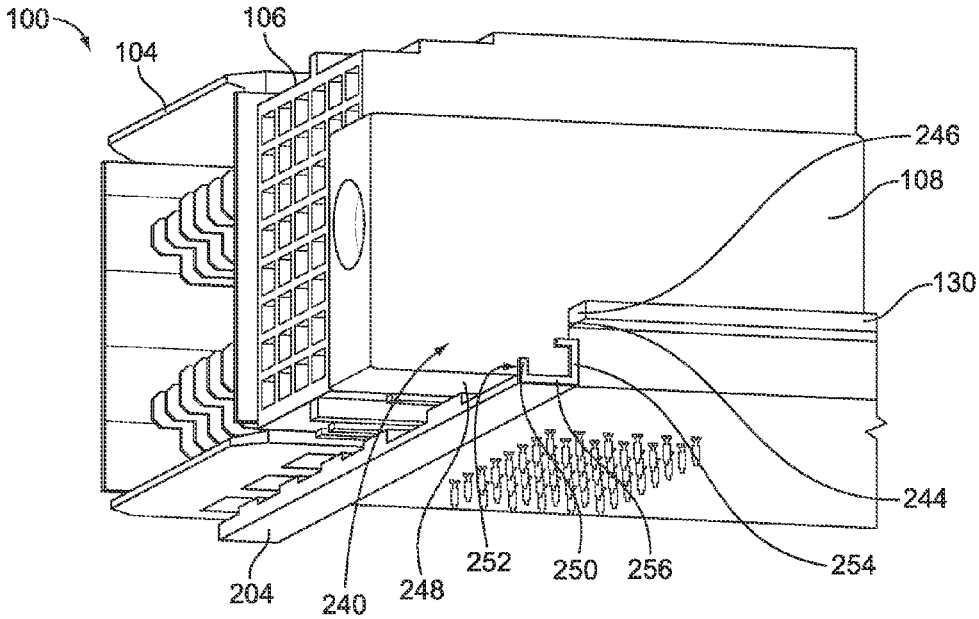
FIG. 3 is a bottom perspective view of the electrical connector assembly shown in FIG. 1.

FIG. 3 is a bottom perspective view of the electrical connector assembly 100 illustrating the front stiffening member 204 coupled to the overhang portions 240. The connector modules 104, 106, 108 have different overall geometries, but share the abutment surfaces 244 along a common plane for abutting against a front edge 246 of the circuit board 130. The abutment surfaces 244 define rear walls of the overhang portions 240, and may be referred to hereinafter as rear walls 244. The overhang portions 240 also include outer walls 248 at a bottom of the overhang portions 240. In the illustrated embodiment, the front stiffening member 204 is coupled to the overhang portions 240 at the outer walls 248 and the rear walls 244.

The front stiffening member 204 holds the relative positions of the connector modules 104, 106, 108 for mounting the electrical connector assembly 100 to the circuit board 130 as a bundled unit. The front stiffening member 204 is a metal component that is shaped to conform to the corresponding connector modules 104, 106, 108 to engage the corresponding connector modules 104, 106, 108. The metal component is rigid and is configured to retain its shape when formed, which allows the front stiffening member 204 to securely hold the connector modules 104, 106, 108 together.

The front stiffening member 204 includes keys 250 that extend into corresponding keyways 252 formed in the outer walls 248 and the rear walls 244. Optionally, if the outer walls 248 and/or rear walls 244 are not coplanar, the shape of the front stiffening member 204 may be configurable, such as by a bending or forming process, to accommodate varying connector geometries.

The front stiffening member 204 includes a rear arm 254 and an outer arm 256 extending from the rear arm 254. The rear arm 254 engages the rear walls 244 and the outer arm 256 engages the outer walls 248. Alternatively, the front stiffening member 204 may include only the rear arm 254 engaging the rear walls 244 or the outer arm 256 engaging only the outer walls 248, but not both.

Figure 4:
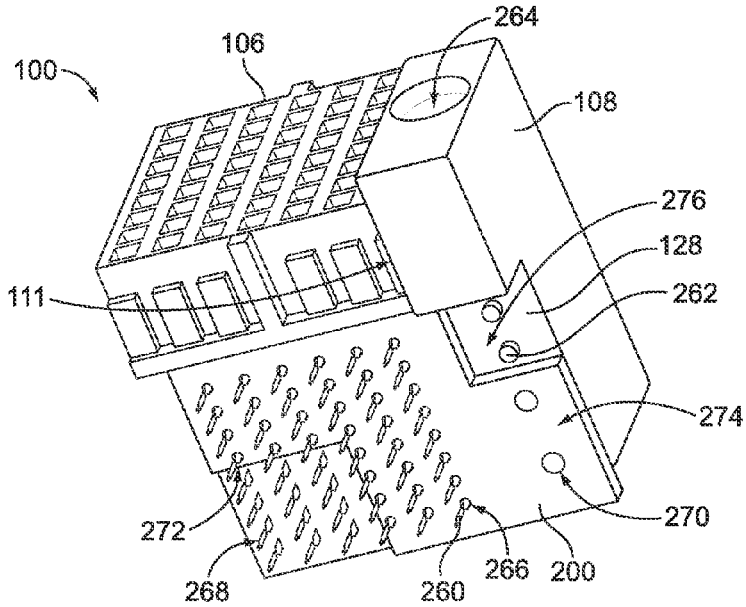
FIG. 4 is another bottom perspective view of a portion of the electrical connector assembly shown in FIG. 1.

FIG. 4 is a bottom perspective view of a portion of the electrical connector assembly 100 illustrating the connector module 106 and the connector module 108 coupled to the organizer 200. The connector module 106 includes a plurality of pins 260 extending from the bottom mounting wall 126 (shown in FIG. 2). The pins 260 may form part of the contacts 132 (shown in FIG. 1) routed through the connector module 106, which are also configured to be mated to corresponding mating contacts of a mating connector. The pins 260 are configured to be terminated to the circuit board 130 (shown in FIGS. 1 and 2). For example, the pins 260 may be press-fit pins configured for press-fit attachment to vias in the circuit board 130 or through-hole pins that are configured to be soldered within vias in the circuit board 130. The contacts tails 260 are arranged in a predetermined pattern, depending on the particular type of connector module being used. The pins 260 make electrical contact with the circuit board 130 to route signals or power through the connector module 106.

The connector module 108 includes a plurality of pins 262 extending from the bottom mounting wall 128. The pins 262 are configured to be mechanically terminated to the circuit board 130 to physically secure the connector module 108 to the circuit board 130. The pins 262 are integrally formed with a housing of the connector module 108 and extend outward from the bottom mounting wall 128. In the illustrated embodiment, the connector module 108 constitutes a guide connector module. No electrical connection is made between the connector module 108 and the circuit board 130, but rather, the connector module 108 includes an opening 264 configured to receive a guide pin or other guidance feature for mating engagement with a mating connector assembly. The connector module 108 operates as a guide module for the electrical connector assembly 100. The contacts tails 262 are arranged in a predetermined pattern, depending on the particular type of connector module being used.

The organizer 200 includes a plurality of openings 266 therethrough arranged in a predetermined pattern. The openings 266 receive the pins 260, 262 of the connector modules 106, 108. When assembled, the organizer 200 abuts against the bottom mounting walls 126, 128 of the connector modules 106, 108, with the pins 260, 262 extending through the openings 266. The pattern of the openings 266 corresponds to the pattern of the pins 260, 262. The openings 266 are arranged in a first set of openings 268 and a second set of openings 270. The organizer 200 is coupled to the connector modules 106, 108 such that at least some of the pins 260 of the connector module 106 extend through the first set of openings 268 and such that at least some of the pins 262 of the connector module 108 extend through the second set of openings 270. The pattern of the first set of openings 268 may be different than the pattern of the second set of openings 270.

The organizer 200 spans across the meeting interface 111 between the connector modules 106, 108. The organizer 200 holds the true position of the pins 260 and/or 262. As such, when the connector modules 106, 108 and organizer 200 are mounted to the circuit board 130, the pins 260 and/or 262 are rigidly held, and properly positioned, with respect to the corresponding vias. Stubbing of the pins 260, 262 is therefore reduced by having the organizer 200 position the pins 260, 262. By engaging the pins 260 and the pins 262 of both connector modules 106, 108, the organizer rigidly holds the connector modules 106, 108 together as a bundled unit. The organizer 200 reduces the possibility of the connector modules 106, 108 spreading apart at the meeting interface 111.

In an exemplary embodiment, the organizer 200 has a stepped configuration, with a first step 272 generally accommodating the pins 260 of the connector module 106 and a second step 274 generally accommodating the pins 262 of the connector module 108. The first step 272 accommodates only a subset of the pins 260, leaving a dead space for another organizer 200 to connect to the pins 260 in such dead space. For example, another organizer 200 may be provided beneath the connector module 104 (shown in FIGS. 1 and 2) and the connector module 106, which spans across the meeting interface 110 (shown in FIGS. 1 and 2). Similarly, the second step 274 accommodates only a subset of the pins 262, leaving a dead space 276 for another organizer 200 to connect to the pins 262 in such dead space. For example, another organizer 200 may be provided beneath the connector module 108 and an adjacent connector module when another connector module is used on the opposite side of the connector module 108 from the connector module 106. In an alternative embodiment, when the connector module 108 (or the other connector modules 104, 106) defines an outermost connector module, wherein no connector modules are provided outside of the connector module 108, the organizer 200 may fill the dead space such that the organizer 200 accommodates all of the pins 262.

Figure 5:
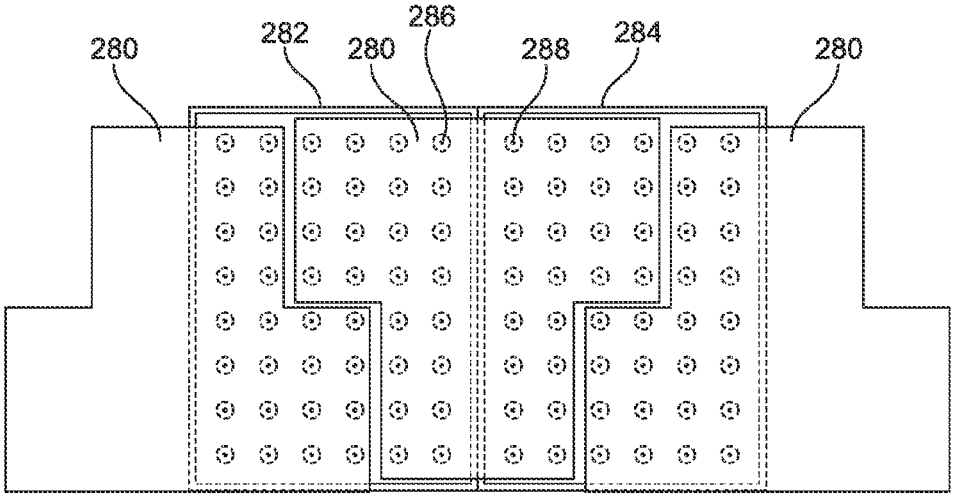
FIGS. 5-8 illustrate alternative carrier systems for the electrical connector assembly.
Figure 6:
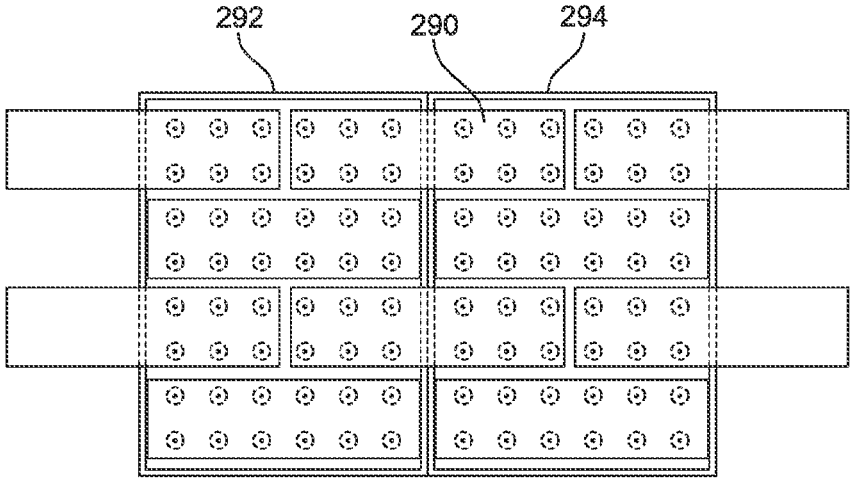

Many different configurations and shapes of organizers 200 are possible in alternative embodiments. Organizers 200 may be provided that extend across more than two connector modules, and may even extend across all of the connector modules utilized within the electrical connector assembly 100. FIGS. 5 and 6 illustrate alternative carrier systems, showing other possible geometries and arrangements for organizers.

FIG. 5 shows three T-shaped organizers 280 mounted to connector modules 282, 284 having similar pinouts of pins 286, 288, respectively. The middle organizer 280 spans across the meeting interface between the connector modules 282, 284 and receives at least some of the pins 286 and at least some of the pins 288. The outer organizers 280 are rotated 180° with respect to the middle organizer 280. The outer organizers 280 may be trimmed or shaped differently, such as an L-shape, if no other connector modules are provided, or may have a different pattern of openings for receiving pins of a different type of connector module.

FIG. 6 shows rectangular organizers 290 arranged in an off-set, stacked configuration, similar to how bricks are stacked. Some of the organizers 290 span across a meeting interface between connector modules 292, 294 and receive pins of both of the connector modules 292, 294. Other organizers 290 only receive pins from one of the connector modules 292 or 294.

Figure 7:
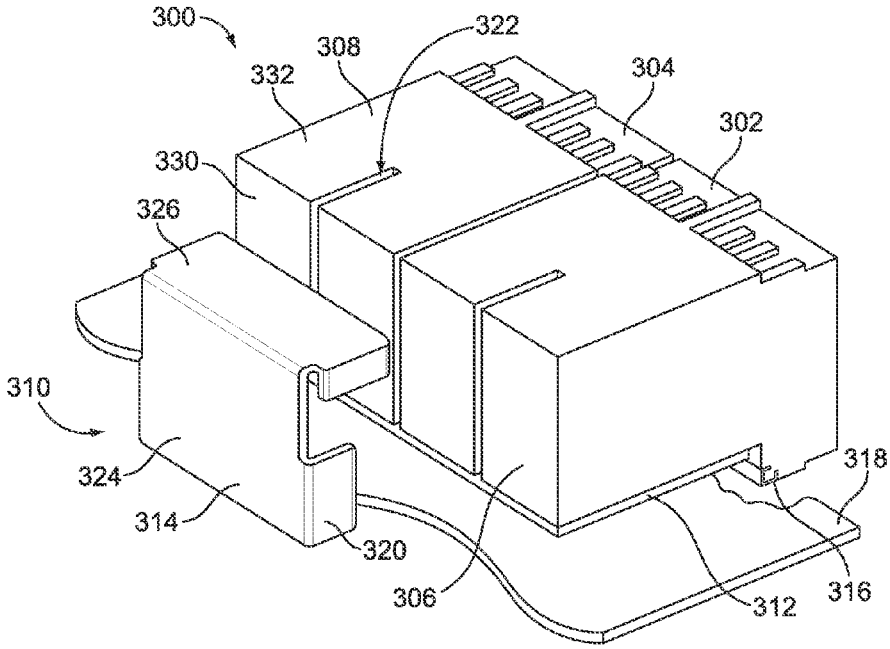

FIG. 7 illustrates an alternative electrical connector assembly 300 having two connector modules 302, 304 that have similar outer perimeters defined by walls 306, 308, respectively. A carrier system 310 ties the connector modules 302, 304 together. The carrier system 310 includes an organizer 312 extending beneath both connector modules 302, 304. The carrier system 310 also includes a rear stiffening member 314 and a front stiffening member 316, which may be similar to the front stiffening member 204 (shown in FIG. 3).

The rear stiffening member 314 holds the relative positions of the connector modules 302, 304 for mounting the electrical connector assembly 300 to a circuit board 318 as a bundled unit. The rear stiffening member 314 is a metal component that is shaped to conform to the corresponding connector modules 302, 304 to engage the corresponding connector modules 302, 304. The metal component is rigid and is configured to retain its shape when formed, which allows the rear stiffening member 314 to securely hold the connector modules 302, 304 together.

The rear stiffening member 314 includes keys 320 that extend into corresponding keyways 322 formed in the walls 306, 308. The rear stiffening member 314 includes a rear arm 324 and an outer arm 326 extending from the rear arm 324. The rear arm 324 engages rear walls 330 and the outer arm 326 engages outer walls 332. Alternatively, the rear stiffening member 314 may include only the rear arm 324 engaging the rear walls 330 or the outer arm 326 engaging only the outer walls 332, but not both. In an exemplary embodiment, single keyways 322 are formed in both the rear walls 330 and the corresponding outer walls 332. As such, the keys 320 extending from the rear arm 324 are received in the same keyways 322 as the keys 320 extending from the outer arm 326.

Figure 8:
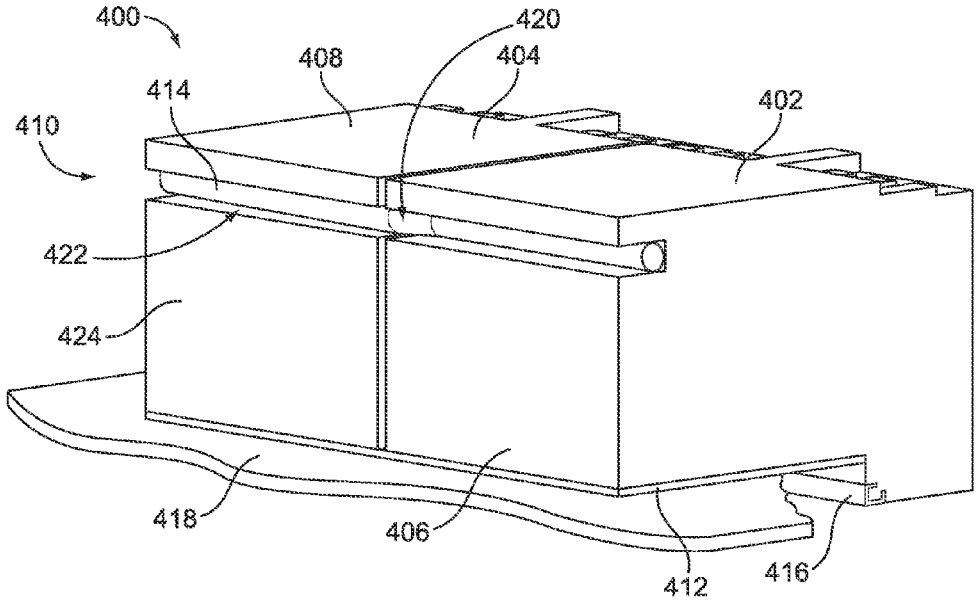

FIG. 8 illustrates an alternative electrical connector assembly 400 having two connector modules 402, 404 that have outer perimeters defined by walls 406, 408, respectively. The outer perimeters of the connector modules 402, 404 are different. For example, the connector module 404 has a depth that is less than a depth of the connector module 402.

A carrier system 410 ties the connector modules together. The carrier system 410 includes an organizer 412 extending beneath both connector modules 402, 404. The carrier system 410 also includes a rear stiffening member 414 and a front stiffening member 416, which may be similar to the front stiffening member 204 (shown in FIG. 4).

The rear stiffening member 414 holds the relative positions of the connector modules 402, 404 for mounting the electrical connector assembly 400 to a circuit board 418 as a bundled unit. The rear stiffening member 414 is a metal rod that is shaped to conform to the corresponding connector modules 402, 404 to engage the corresponding connector modules 402, 404. In the illustrated embodiment, the rear stiffening member 414 is generally cylindrical in shape, however other shapes are possible in alternative embodiments. The rear stiffening member 414 includes a transition section 420 that transitions between the connector modules 402, 404 to engage both connector modules 402, 404. The transition section 420 is formed by bending the rear stiffening member 414 to generally follow the outer perimeter of the connector modules 402, 404.

The walls 406, 408 include keyways 422 that receive the rear stiffening member 414. The keyways 422 represent a groove formed in rear walls 424 of the connector modules 402, 404. Because the connector module 404 is off-set with respect to the connector module 402, the rear stiffening member 414 transitions across the meeting interface to engage both keyways 422. Optionally, the keyways 422 may both be positioned at approximately the same height from the circuit board 418. Alternatively, the keyways 422 may be at different heights from the circuit board 418 and the rear stiffening member 414 must transition either up or down to be loaded into the corresponding keyways 422.

Figure 9:
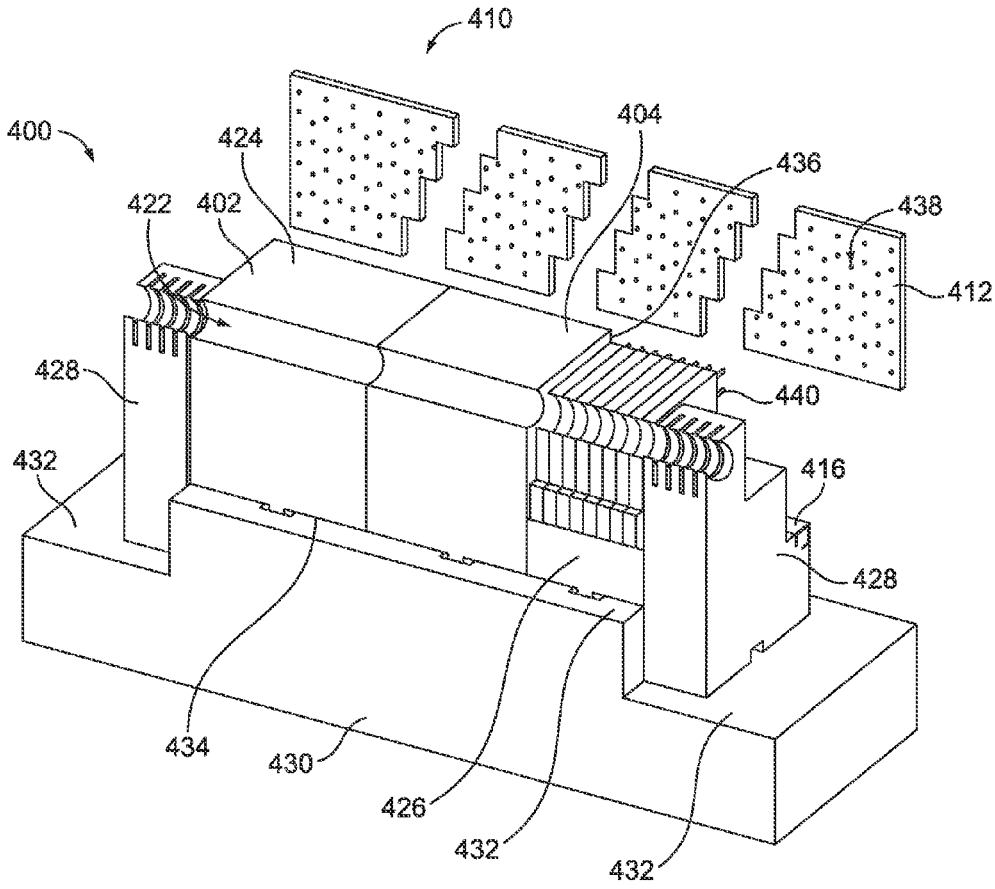
FIG. 9 illustrates a fixture configured to hold the connector modules forming the electrical connector assembly during application of the carrier system to the connector modules.

FIG. 9 illustrates a fixture 430 configured to hold the connector modules 402, 404, as well as other connector modules 426, 428, forming the electrical connector assembly 400 during application of the carrier system 410 to the connector modules 402, 404, 426, 428. The fixture 430 may form part of the carrier system 410, and may be used during mounting of the electrical connector assembly 400 to the circuit board 418 (shown in FIG. 8). The fixture 430 may be removed from the connector modules 402, 404, 426, 428 after the connector modules 402, 404, 426, 428 are mounted to the circuit board 418.

In the illustrated embodiment, the connector modules 402, 404 constitute signal electrical connectors. The connector module 426 constitutes a power electrical connector. Two of the connector modules 428 are provided, which flank the other connector modules 402, 404, 426. The connector modules 428 constitute guide modules.

During assembly, the connector modules 402, 404, 426, 428 are loaded onto the fixture 430. The connector modules 402, 404, 426, 428 may be secured to the fixture 430, such as using adhesives, latches, tape, fasteners, an interference fit, and the like. The fixture 430 includes steps 432 that position the connector modules 402, 404, 426, 428 in a particular orientation with respect to one another. For example, front mating walls 434 of the connector modules 402, 404, 426, 428 rest on the fixture 430. The steps 432 allow the front mating walls 434 to be staggered, which orients the rear walls 424 at particular locations, such as aligned with one another, as in the illustrated embodiment. As a result, the keyways 422 of each of the connector modules 402, 404, 426, 428 are generally aligned with one another.

The organizers 412 are coupled to bottom mounting walls 436 of the connector modules 402, 404, 426, 428. The organizers 412 have a stepped configuration, where the organizers 412 are interfitted with adjacent organizers 412. The organizers 412 have openings 438 that receive pins 440 extending from the bottom mounting walls 436 of the connector modules 402, 404, 426, 428.

The front stiffening member 416 is coupled to the connector modules 402, 404, 426, 428. Similarly, the rear stiffening member 414 (shown in FIG. 8) is coupled to the connector modules 402, 404, 426, 428 by loading the rear stiffening member 414 into the keyways 422. Once assembled, the fixture 430 may be removed and the remaining electrical connector assembly 400 may be mounted to the circuit board 418. Alternatively, the fixture 430 may be utilized as part of the carrier system 410, wherein the electrical connector assembly 400, including the fixture 430, is mounted to the circuit board 418. After being mounted, the fixture 430 may be removed. In another alternative embodiment, the fixture 430 may be used to replace the front stiffening member 416, whereby the fixture 430 holds the front mating walls 434 in position relative to one another during mounting to the circuit board 418. As such, the fixture 430 may define a front stiffening member.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a first connector module including a bottom mounting wall and pins extending from the bottom mounting wall, the pins being configured to be terminated to a circuit board;

a second connector module including a bottom mounting wall and pins extending from the bottom mounting wall, the pins being configured to be terminated to the circuit board; and a carrier system comprising an organizer having an upper surface and a lower surface with openings therethrough in a predetermined pattern, the organizer being coupled to the first and second connector modules such that the upper surface engages the bottom mounting walls of the first and second connector modules, at least some of the pins of the first connector module extend through the openings of the organizer, and at least some of the pins of the second connector module extend through the openings of the organizer;

wherein the first connector module includes walls defining an outer perimeter and the second connector module includes walls defining an outer perimeter, wherein at least one of the walls of the second connector module is off-set with respect to corresponding walls of the first connector module such that the outer perimeters of the first and second connector modules are out of alignment with respect to one another, the carrier system further comprising a stiffening member being coupled to the first and second connector modules, the stiffening member having a transition section spanning between corresponding walls of the first and second connector modules that are offset with respect to one another to hold the first and second connector modules together;

wherein the first connector module, the second connector module and the organizer are configured to be mounted to the circuit board as a bundled unit.

2. The electrical connector assembly of claim 1, wherein the pins are compliant pins configured to be received in vias in the circuit board, the organizer holds a true position of the pins for mating with the circuit board.

3. The electrical connector assembly of claim 1, wherein the organizer includes a first set of openings receiving the pins of the first connector module, and the organizer includes a second set of openings receiving the pins of the second connector module.

4. The electrical connector assembly of claim 1, wherein the organizer includes a first set of openings receiving the pins of the first connector module being arranged in a first pattern, and the organizer includes a second set of openings receiving the pins of the second connector module being arranged in a second pattern different than the first pattern.

5. The electrical connector assembly of claim 1, wherein the organizer rigidly holds the first and second connector modules in position with respect to one another.

6. The electrical connector assembly of claim 1, wherein the first and second connector modules are held adjacent one another at a meeting interface, the organizer spanning across the meeting interface.

7. The electrical connector assembly of claim 1, wherein the organizer is a planar sheet with the lower surface being configured to be mounted to the circuit board such that the organizer is positioned directly between the circuit board and the bottom mounting walls of the first and second connector modules.

8. An electrical connector assembly comprising:

a first connector module includes walls defining an outer perimeter, the first connector module including pins configured to be terminated to a circuit board;

a second connector module includes walls defining an outer perimeter, wherein at least one of the walls of the second connector module is off-set with respect to corresponding walls of the first connector module such that the outer perimeters of the first and second connector modules are out of alignment with respect to one another, the second connector module including pins configured to be terminated to the circuit board; and a carrier system comprising an organizer having openings therethrough in a predetermined pattern, the organizer being coupled to the first and second connector modules such that at least some of the pins of the first connector module extend through the openings of the organizer and such that at least some of the pins of the second connector module extend through the openings of the organizer, the carrier system further comprising a stiffening member being coupled to the first and second connector modules, the stiffening member having a transition section spanning between corresponding walls of the first and second connector modules that are offset with respect to one another to hold the first and second connector modules together;

wherein the first connector module, the second connector module and the carrier system are configured to be mounted to the circuit board as a bundled unit.

9. The electrical connector assembly of claim 8, wherein the first connector module includes a first rear wall and the second connector module includes a second rear wall positioned forward of the first rear wall, the stiffening member including a rear arm defining the transition section spanning a meeting interface between the first and second rear walls such that the rear arm is non-coplanar.

10. The electrical connector assembly of claim 8, wherein the first connector module includes a first rear wall and the second connector module includes a second rear wall positioned forward of the first rear wall, the stiffening member including a rear arm having a first rear arm section extending along the first rear wall, a second rear arm section extending along the second rear wall and the transition section between the first and second rear arm sections, the first rear arm section being parallel to, and non-coplanar with respect to, the second rear arm section, the transition section being non-parallel with respect to the first and second rear arm sections.

11. The electrical connector assembly of claim 8, wherein the walls of the first and second connector modules include keyways, the stiffening member including keys fitting into the corresponding keyways to hold the relative position of the stiffening member with respect to the first and second connector modules.

12. The electrical connector assembly of claim 8, wherein the first and second connector modules include overhang portions configured to extend along an edge of the circuit board, the overhang portions having abutment faces facing the edge of the circuit board, the abutment faces being aligned coplanar with one another, the stiffening member extending along and engaging the abutment faces to hold the first and second connector modules together.

13. The electrical connector assembly of claim 8, wherein the first and second connector modules include keyways in corresponding walls, the stiffening member being a rod being received in the corresponding keyways of the first and second connector modules.

14. The electrical connector assembly of claim 8, wherein the walls of the first and second connector modules include bottom walls configured to be mounted to the circuit board, outer walls opposite the bottom walls, mating walls configured for mating with a mating connector, and rear walls opposite the mating walls, the first and second connector modules being positioned adjacent one another along a meeting interface, the stiffening member spanning across the meeting interface along at least one of the outer walls or the rear walls.

15. An electrical connector assembly comprising:

a first connector module includes walls defining an outer perimeter, the first connector module being configured to be mounted to a circuit board;

a second connector module includes walls defining an outer perimeter, the second connector module being configured to be mounted to the circuit board adjacent the first connector module, wherein at least one of the walls of the first connector module is off-set with respect to corresponding walls of the second connector module such that the outer perimeters of the first and second connector modules are out of alignment with respect to one another; and a carrier system comprising a stiffening member being coupled to the first and second connector modules, the stiffening member having a transition section spanning between corresponding walls of the first and second connector modules that are offset with respect to one another;

wherein the first connector module, the second connector module and the stiffening member are configured to be mounted to the circuit board as a bundled unit.

16. The electrical connector assembly of claim 15, wherein the first and second connector modules are positioned adjacent one another along a meeting interface, the walls of the first and second connector modules including rear walls perpendicular to the meeting interface, the rear walls being offset from one another with the rear wall of the first connector module being positioned forward of the rear wall of the second connector module, the stiffening member spanning across the meeting interface and engaging the rear wall of the first connector module and the rear wall of the second connector module.

17. The electrical connector assembly of claim 15, wherein the first and second connector modules are positioned adjacent one another along a meeting interface, the walls of the first and second connector modules including outer walls opposite mounting walls configured to be mounted to the circuit board, the outer walls being perpendicular to the meeting interface, the outer walls being offset from one another with the outer wall of the first connector module being positioned closer to the circuit board than the outer wall of the second connector module, the stiffening member spanning across the meeting interface and engaging the outer wall of the first connector module and the outer wall of the second connector module.

18. The electrical connector assembly of claim 15, wherein the first connector module includes a first rear wall and the second connector module includes a second rear wall positioned forward of the first rear wall, the stiffening member including a rear arm having a first rear arm section extending along the first rear wall and a second rear arm section extending along the second rear wall with the transition section between the first and second rear arm sections, the first rear arm section being parallel to, and non-coplanar with respect to, the second rear arm section, the transition section being non-parallel with respect to the first and second rear arm sections.

19. The electrical connector assembly of claim 15, wherein the first connector module includes a first outer wall and the second connector module includes a second outer wall positioned above the first outer wall, the stiffening member including an outer arm having a first outer arm section extending along the first outer wall and a second outer arm section extending along the second outer wall with the transition section between the first and second outer arm sections, the first outer arm section being parallel to, and non-coplanar with respect to, the second outer arm section, the transition section being non-parallel with respect to the first and second outer arm sections.

* * * * *